US008988171B2

(12) United States Patent
Kai

(10) Patent No.: US 8,988,171 B2
(45) Date of Patent: Mar. 24, 2015

(54) MULTI-RESONATOR WAVEGUIDE BANDPASS FILTER

(75) Inventor: Takafumi Kai, Tokyo (JP)

(73) Assignee: NEC Corporation, Tokyo (JP)

( * ) Notice: Subject to any disclaimer, the term of this patent is extended or adjusted under 35 U.S.C. 154(b) by 552 days.

(21) Appl. No.: 13/139,554

(22) PCT Filed: Dec. 17, 2009

(86) PCT No.: PCT/JP2009/006966

§ 371 (c)(1),
(2), (4) Date: Jun. 14, 2011

(87) PCT Pub. No.: WO2010/073554

PCT Pub. Date: Jul. 1, 2010

(65) Prior Publication Data

US 2011/0241795 A1 Oct. 6, 2011

(30) Foreign Application Priority Data

Dec. 26, 2008 (JP) ..... 2008-332321

(51) Int. Cl.
*H01P 1/208* (2006.01)
*H01P 5/12* (2006.01)
*H01P 1/207* (2006.01)

(52) U.S. Cl.
CPC ..... *H01P 1/207* (2013.01)
USPC ..... 333/209; 333/208

(58) Field of Classification Search
USPC ..... 333/208, 209
See application file for complete search history.

(56) References Cited

U.S. PATENT DOCUMENTS

| | | | | | |
|---|---|---|---|---|---|
| 3,614,672 | A * | 10/1971 | Newbould | ..... | 333/113 |
| 3,914,713 | A * | 10/1975 | Konishi et al. | ..... | 333/21 R |
| 4,800,349 | A * | 1/1989 | Gurcan et al. | ..... | 333/208 |
| 6,331,809 | B1 * | 12/2001 | Takakuwa et al. | ..... | 333/135 |
| 2005/0287977 | A1 * | 12/2005 | Tong et al. | ..... | 455/339 |
| 2008/0197944 | A1 * | 8/2008 | Tsuji et al. | ..... | 333/208 |
| 2008/0246558 | A1 * | 10/2008 | Brown et al. | ..... | 333/160 |

FOREIGN PATENT DOCUMENTS

| | | | |
|---|---|---|---|
| JP | 62-5702 | A | 1/1987 |
| JP | 6-291512 | A | 10/1994 |
| JP | 2005269012 | A | 9/2005 |
| JP | 2008283617 | A | 11/2008 |

OTHER PUBLICATIONS

International Search Report of PCT Application No. PCT/JP2009/006966 mailed Mar. 23, 2010.

* cited by examiner

*Primary Examiner* — Stephen E Jones
*Assistant Examiner* — Scott S Outten
(74) *Attorney, Agent, or Firm* — Sughrue Mion, PLLC

(57) ABSTRACT

A bandpass filter of the present invention includes: rectangular waveguides which are divided into two in a center of a broad plane; and a metal plate which has a substantially ladder shape, is disposed between the rectangular waveguides in parallel with a narrow plane of the rectangular waveguides, and has a pair of beams and plurality of fins that connect the pair of beams. At least one other waveguide is formed by dividing a waveguide path within the rectangular waveguides vertically with respect to a direction which is parallel with the broad plane. At least three resonators are formed within the rectangular waveguides by the metal plate, and each of the other waveguides couples resonators together which crosses at least one of the plurality of resonators so as to form a pole outside a pass band.

7 Claims, 8 Drawing Sheets

MULTI-RESONATOR WAVEGUIDE BANDPASS FILTER

TECHNICAL FIELD

The present invention relates to a bandpass type of filter that includes an E-plane parallel metal plate and, in particular, to a bandpass filter that includes a cross-coupling waveguide path within the waveguide.

BACKGROUND ART

When developing radio equipment, the aim is to achieve the maximum performance and the optimum functional characteristics in as small a space as possible.

The physical dimensions of passive circuits such as filters are determined by the design frequency. Consequently, there is only a small degree of freedom from the viewpoint of the flexible packaging of the respective components.

For example, in a bandpass filter which includes an E-plane parallel metal plate, the level of satisfaction with the standard in the pass bands (i.e., the abruptness of boundaries with stop bands) is decided solely by the number of stages. Because of this, there are cases when the overall filter length is too long for the space provided.

In bandpass filters in which a plurality of resonators are aligned in a row, technology is known in which, by coupling resonators together by crossing one or more resonators, an attenuation pole is created on the outside of the pass band thereby improving the attenuation characteristics.

"The combline bandpass filter" disclosed in Patent document 1 is known as a bandpass filter in which cross-coupling lines are formed. In the invention disclosed in Patent document 1, on the inside of one side surface of a metal case, a metal coupling loop is installed with one end thereof being bent in the direction of the open end of a resonance conductor, and the other end thereof being bent in the direction of the short-circuit end of the resonance conductor.

PRIOR ART DOCUMENT

Patent Document

[Patent Document 1] Japanese Unexamined Patent Application, First Publication No. H6-291512

SUMMARY OF THE INVENTION

Problem to be Solved by the Invention

However, the working of the metal coupling loop of the invention disclosed in Patent document 1, as well as the installation thereof inside a metal case are not simple tasks.

In some cases, a coaxial line is used for the cross-coupling line. However, in the same way as in the invention disclosed in Patent document 1, this is not straightforward from the viewpoint of creating a waveguide path, and a coaxial line also generates considerable loss.

The present invention has been conceived in view of the above described problems. One example of objects of the present invention is to provide a bandpass filter having simplified component shapes and also having simplified assembly, and which also has superior attenuation characteristics.

Means for Solving the Problem

A bandpass filter of the present invention includes: rectangular waveguides which are divided into two in a center of a broad plane; and a metal plate which has a substantially ladder shape, and is disposed between the rectangular waveguides in parallel with a narrow plane of the rectangular waveguides, and has a pair of beams and plurality of fins that connect the pair of beams. At least one other waveguide is formed by dividing a waveguide path within the rectangular waveguides vertically with respect to a direction which is parallel with the broad plane. At least three resonators is formed within the rectangular waveguides by the metal plate, and each of the other waveguides couples resonators together which crosses at least one of the plurality of resonators so as to form a pole outside a pass band.

Effect of the Invention

According to the present invention, it is possible to provide a bandpass filter having simplified component shapes and also having simplified assembly, and which also has superior attenuation characteristics.

EMBODIMENTS FOR CARRYING OUT THE INVENTION

First Exemplary Embodiment

A first exemplary embodiment in which the present invention has been favorably implemented will now be described.

Figure 1:
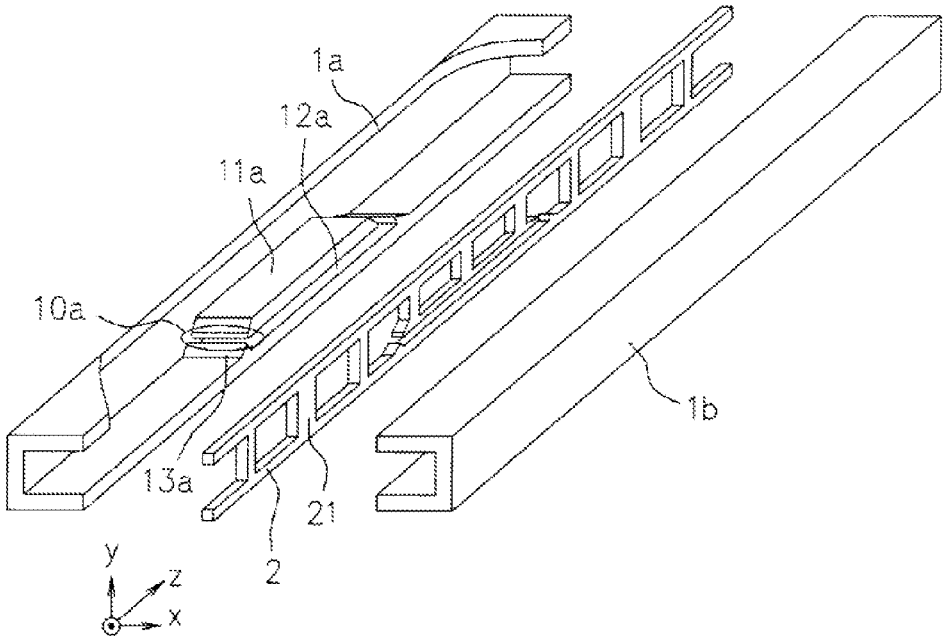
FIG. 1 is a view showing the structure of a bandpass waveguide filter according to a first exemplary embodiment of the present invention.

FIG. 1 shows the structure of a bandpass waveguide filter according to the present exemplary embodiment. A coordinate system is set in which the longitudinal direction of the waveguide is set parallel to the z-direction, an H-plane (broad plane, first plane) is set parallel to the xz-plane, and an E-plane (narrow plane, second plane) is set parallel to the yz-plane. The width of the E-plane is narrower than the width of the H-plane. The E-plane may also be perpendicular relative to the H-plane.

Rectangular waveguides 1*a* and 1*b* which are divided into two at the center of the H-plane sandwich an E-plane parallel metal plate 2 so as to form a single waveguide. A coupling coefficient which is required for the bandpass filter is set to a desired value via the shape (i.e., via the plate thickness and the fin width and interval) of fins 21 which are disposed in a ladder shape.

A protruding portion 11*a* which protrudes in parallel with the xz-plane is formed inside the rectangular waveguide 1*a*. A groove 12*a* which extends in the z-direction and whose depth direction extends in the x-direction and whose width direction extends in the y-direction is formed between the protruding portion 11*a* and an inside wall of the H-plane of the waveguide. The depth of the groove 12*a* is set in accordance with the coupling amount of the cross-coupled waveguide. It is not essential for the groove 12*a* to reach as far as the inside wall of the rectangular waveguide 1*a* (i.e., the E-plane).

Slope portions 13*a* are formed on the inside of the H-plane of the rectangular waveguide 1*a* with gaps provided between themselves and the end portions of the groove 12*a* in order to adjust the coupling amount. The opening direction of coupling windows 10*a* is set at an optional angle relative to the longitudinal direction of the rectangular waveguide 1*a*. The dimensions of the fins 21 located at the front and rear of the coupling windows 10*a* are adjusted to dimensions which are different from those of the other fins 21 in order to adjust the coupling amount.

Although it is obscured in FIG. 1 by the waveguide wall, the other rectangular waveguide 1*b* has the same structure as the rectangular waveguide 1*a*.

Figure 2:
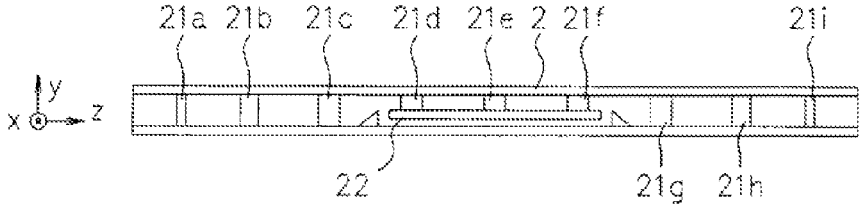
FIG. 2 is a view showing the structure of an E-plane parallel metal plate which is used in the bandpass waveguide filter according to the first exemplary embodiment of the present invention.

The E-plane parallel metal plate 2 forms a plurality of, namely, three or more resonators within the rectangular waveguides 1*a* and 1*b*. The E-plane parallel metal plate 2 is formed such that there are no fins 21 in the portion thereof which corresponds to the grooves in the rectangular waveguides 1*a* and 1*b*. In other words, the E-plane parallel metal plate 2 has an open portion which corresponds to the shape of the grooves (namely, an open portion which has the same shape as the shape of the grooves) in a portion thereof which corresponds to the grooves in the rectangular waveguides 1*a* and 1*b*. Namely, as is shown in FIG. 2, in a portion of the E-plane parallel metal plate 2 which corresponds to the position where the grooves 12*a* and 12*b* are located, the fins 21*d* to 21*f* are supported in a cantilever fashion, and a beam portion 22 is provided at a distal end thereof.

Figure 3:
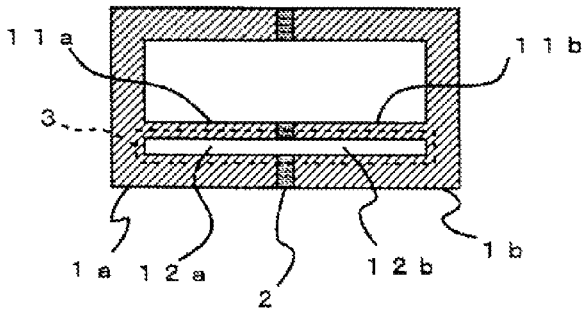
FIG. 3 is a cross-sectional view showing the bandpass waveguide filter according to the first exemplary embodiment of the present invention.

As a result of the E-plane parallel metal plate 2 being sandwiched between the pair of rectangular waveguides 1*a* and 1*b*, as is shown in FIG. 3, a separate quadrangular waveguide-shaped waveguide path is formed inside the waveguide. Namely, inside the rectangular waveguides 1*a* and 1*b*, at least one other waveguide is formed as a result of the waveguide path being divided vertically in a direction which is parallel to the H-plane. This waveguide-shaped waveguide path forms a cross-coupling waveguide path 3 which couples together the resonators of the bandpass filter. Namely, the cross-coupling waveguide path 3 couples resonators together by crossing at least one of the plurality of resonators that are formed inside the rectangular waveguides 1*a* and 1*b* by the E-plane parallel metal plate 2. The cross-coupling waveguide path 3 functions as a cross-coupling line. The cross-coupling waveguide path 3 has a flat shape in which the height (i.e., the y-direction) dimension is smaller than the width (i.e., the x-direction) dimension. However, the aspect ratio thereof is not limited to any specific value and is a value which corresponds to the coupling amount.

Figure 4:
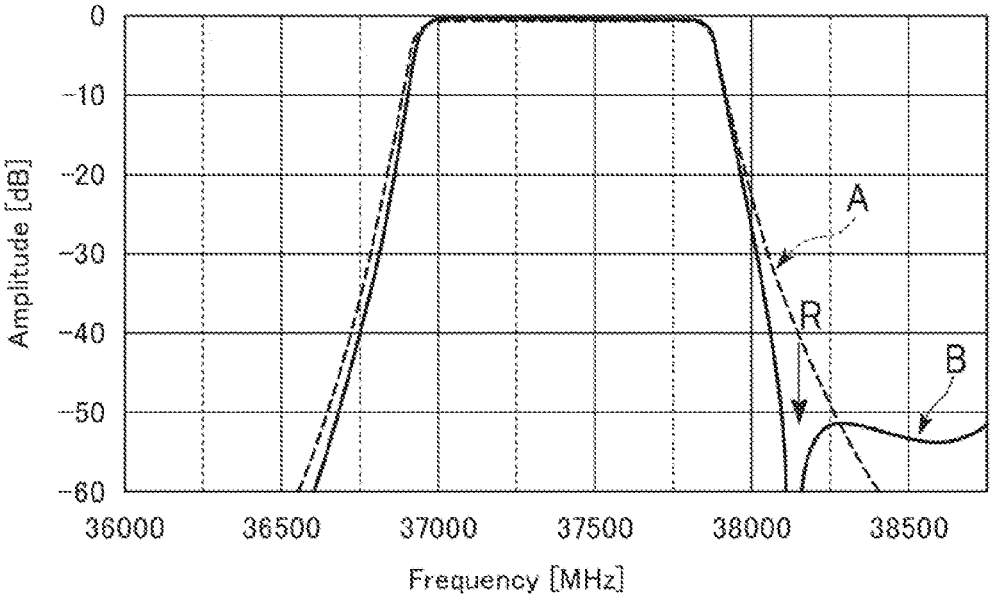
FIG. 4 is a view showing an example of the pass characteristics of a bandpass filter.

FIG. 4 shows the pass characteristics of a 38 GHz band model bandpass filter. In FIG. 4, the curved line shown by the arrow A shows the pass characteristics of a bandpass filter when there is no cross-coupling. In FIG. 4, the curved line shown by the arrow B shows the pass characteristics of a bandpass filter when there is cross-coupling. As is shown in FIG. 4, at least one pole is formed by coupling resonators together using a cross-coupling line. The number of poles and the positions where they are formed can be altered by selecting the resonators to be coupled together.

In FIG. 4, at a position R where the pole is formed (in the vicinity of 38.15 GHz) the amount of attenuation is improved by not less than 20 dB.

The present invention is achieved not only when the dimensions and shapes of the coupling windows, fins, and slope portions are limited to particular numerical values and shapes, and the dimensions and the like of the coupling windows, fins, and slope portions can be adjusted in order to adjust the number and positions of the poles in accordance with the desired characteristics. As a consequence, a detailed description of the adjustment of the coupling amount is omitted here.

In the above described structure, because a separate waveguide (i.e., a cross-coupling waveguide path) is formed inside the rectangular waveguides 1*a* and 1*b*, there is no need for the external dimensions of the bandpass filter to be changed. As a consequence, restrictions on the packaging space are alleviated and it is simple for the respective components inside a device to be packaged with flexibility.

Here, a structure in which the bandpass waveguide filter is symmetrical in the longitudinal direction of the rectangular waveguides is described as an example. However, it is not necessary for the bandpass waveguide filter to be symmetrical in the longitudinal direction of the rectangular waveguides.

In this manner, a cross-coupling waveguide path is formed inside a rectangular waveguide, and a pole is generated by cross-coupling resonators together, and the coupling amount is adjusted such that this pole is formed outside a pass band in a transient area between the pass band and a stop band. By employing this type of structure, it is possible to improve the pass characteristics of a bandpass filter.

Second Exemplary Embodiment

A second exemplary embodiment in which the present invention has been favorably implemented will now be described. In the same way as in the first exemplary embodiment, the bandpass waveguide filter of the present exemplary embodiment has a structure in which an E-plane parallel metal plate is sandwiched between a pair of rectangular waveguides which are divided into two at the center of the H-plane.

Figure 5A:
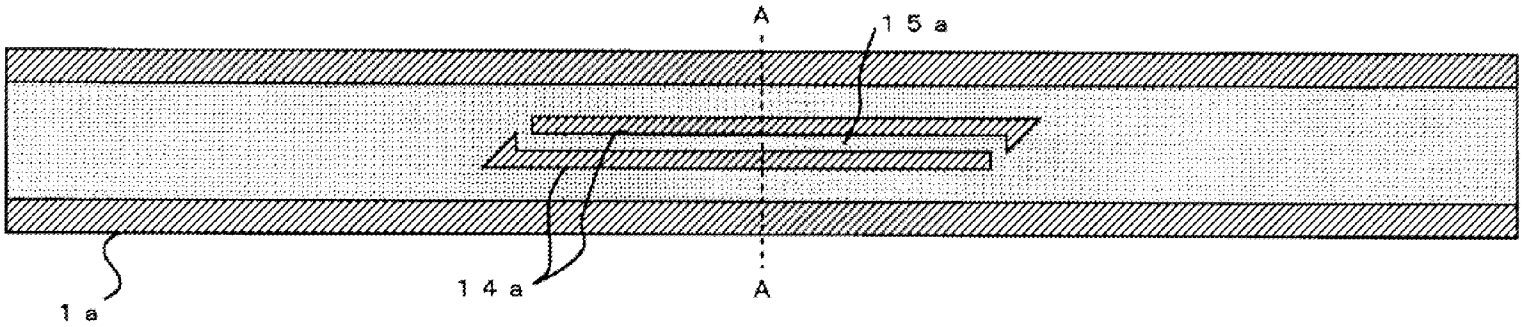
FIG. 5A is a view showing the structure of a rectangular waveguide which is applied to a bandpass waveguide filter according to a second exemplary embodiment of the present invention.
Figure 5B:
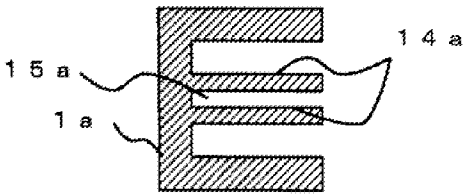
FIG. 5B is a cross-sectional view showing the structure of a rectangular waveguide taken along a line A-A shown in FIG. 5A.

FIG. 5A shows the structure of the inside of a rectangular waveguide 1*a* which constitutes the bandpass waveguide filter of the present exemplary embodiment. FIG. 5B is a cross-sectional view showing the rectangular waveguide 1*a* taken along a line A-A shown in FIG. 5A. In the present exemplary embodiment, a pair of protruding portions 14*a* are formed substantially parallel with the H-plane in the vicinity of the center in the height direction of the E-plane of the rectangular waveguide 1*a*. The portion which is sandwiched between the pair of protruding portions 14*a* forms a groove 15*a*.

Figure 5C:
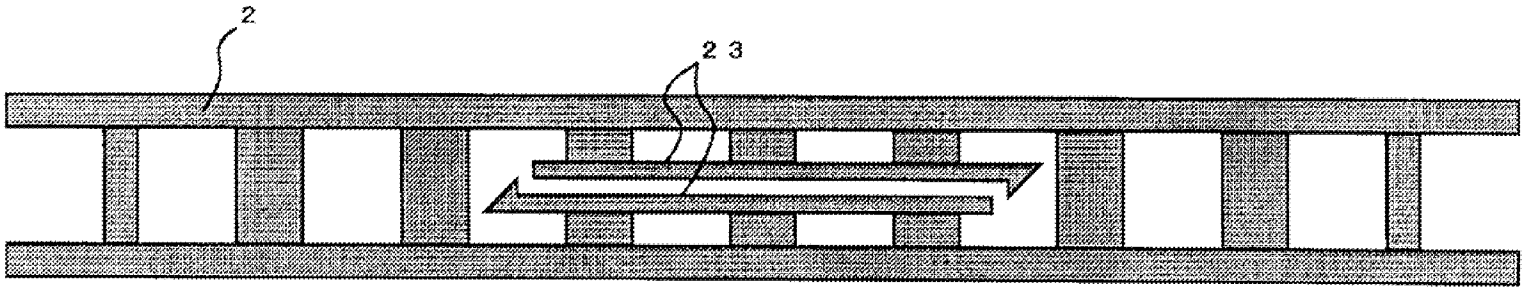
FIG. 5C is a view showing the structure of an E-plane parallel metal plate which is applied to the bandpass waveguide filter according to the second exemplary embodiment of the present invention.

FIG. 5C shows the structure of an E-plane parallel metal plate 2 which constitutes the bandpass waveguide filter of the present exemplary embodiment. A pair of beam portions 23 which correspond to the pair of protruding portions 14*a* are each supported in a cantilever fashion by fins.

One end of each pair of protruding portions 14*a* and beam portions 23 is formed in a slope shape, and the coupling amount can be adjusted by altering the shape and dimensions of this portion.

The structure of the rectangular waveguide 1*b* is the same as that of the rectangular waveguide 1*a*.

Figure 6:
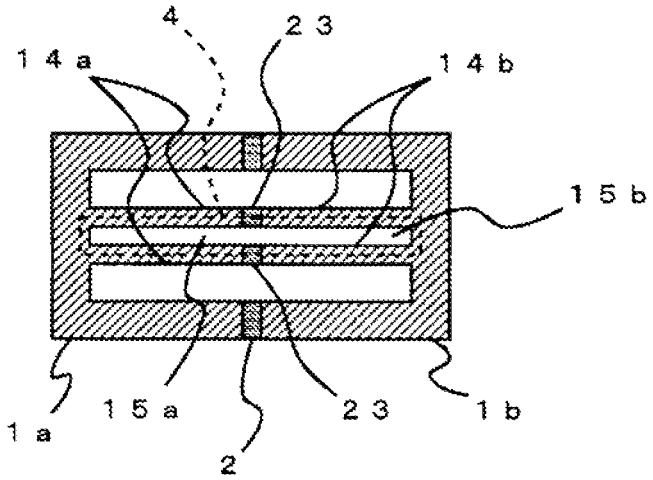
FIG. 6 is a cross-sectional view showing a bandpass waveguide filter according to the second exemplary embodiment of the present invention.

As is shown in FIG. 6, in the present exemplary embodiment, if the E-plane parallel metal plate 2 is sandwiched between the pair of rectangular waveguides 1*a* and 1*b*, then a cross-coupling waveguide path 4 is formed in a center portion in the height direction of the waveguide.

In the bandpass waveguide filter of the present exemplary embodiment as well, in the same way as in the first exemplary embodiment, a pole is generated by cross-coupling resonators together, and the coupling amount is adjusted such that this pole is positioned outside a pass band in a transient area between the pass band and a stop band. By employing this type of structure, it is possible to improve the pass characteristics of a bandpass filter.

Third Exemplary Embodiment

A third exemplary embodiment in which the present invention has been favorably implemented will now be described. In the same way as in the bandpass waveguide filters of the first and second exemplary embodiments, the bandpass waveguide filter of the present exemplary embodiment has a structure in which an E-plane parallel metal plate is sandwiched between a pair of rectangular waveguides which are divided into two at the center of the H-plane.

Figure 7A:
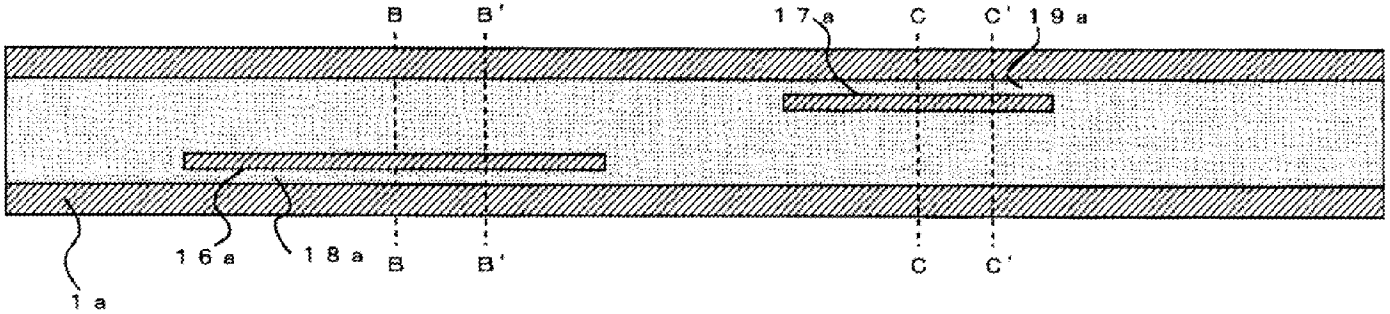
FIG. 7A is a view showing the structure of a rectangular waveguide which is applied to a bandpass waveguide filter according to a third exemplary embodiment of the present invention.
Figure 7B:
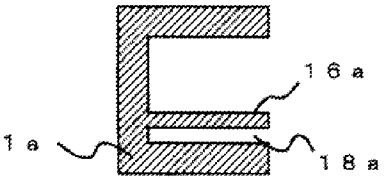
FIG. 7B is a cross-sectional view showing a rectangular waveguide taken along lines B-B and B'-B' shown in FIG. 7A.
Figure 7C:
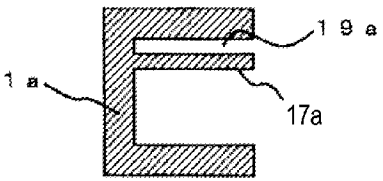
FIG. 7C is a cross-sectional view showing a rectangular waveguide taken along lines C-C and C'-C' shown in FIG. 7A.

FIG. 7A shows the structure of the inside of a rectangular waveguide 1*a* which constitutes the bandpass waveguide filter of the present exemplary embodiment. FIG. 7B is a cross-sectional view showing the rectangular waveguide 1*a* taken along lines B-B and B'-B' shown in FIG. 7A. FIG. 7C is a cross-sectional view showing the rectangular waveguide 1*a* taken along lines C-C and C'-C' shown in FIG. 7A. In the present exemplary embodiment, two protruding portions 16*a* and 17*a* are formed at different positions in the longitudinal direction of the rectangular waveguide 1*a*. One protruding portion 16*a* is provided substantially parallel with the H-plane in the vicinity of the H-plane on the underside of the rectangular waveguide 1*a*. The other protruding portion 17*a* is provided substantially parallel with the H-plane in the vicinity of the H-plane on the topside of the rectangular waveguide 1*a*. Grooves 18*a* and 19*a* are formed between the protruding portions 16*a* and 17*a* and the inner walls of the waveguide.

Figure 7D:
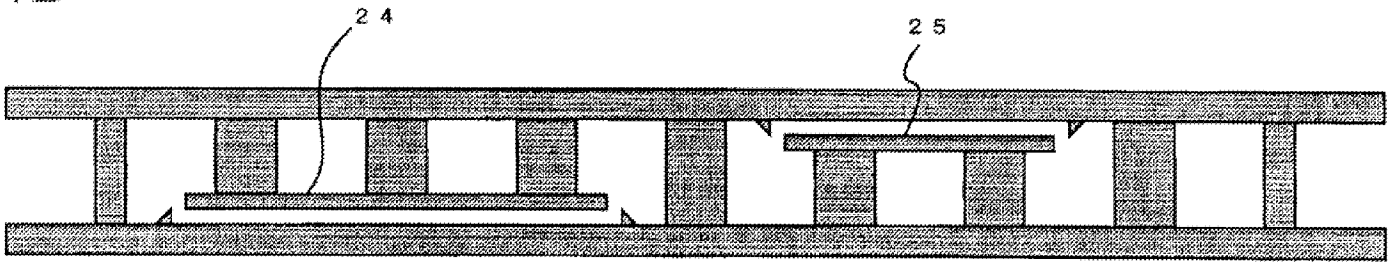
FIG. 7D is a view showing the structure of an E-plane parallel metal plate which is applied to the bandpass waveguide filter according to the third exemplary embodiment of the present invention.

There are no fins in those portions of the E-plane parallel metal plate 2 which correspond respectively to the two grooves 18*a* and 19*a* in the rectangular waveguide 1*a*. In other words, the E-plane parallel metal plate 2 has open portions which correspond to the shape of the grooves (namely, open portions which have the same shape as the shape of the grooves) in portions thereof which correspond to the grooves in the rectangular waveguides 5 and 6. Namely, as is shown in FIG. 7D, in portions which correspond to the respective positions where the grooves 18 and 19 are located, the fins are supported in a cantilever fashion. Beam portions 24 and 25 are provided at a distal end of these fins.

The structure of the rectangular waveguide 1*b* is the same as that of the rectangular waveguide 1*a*.

Figure 8A:
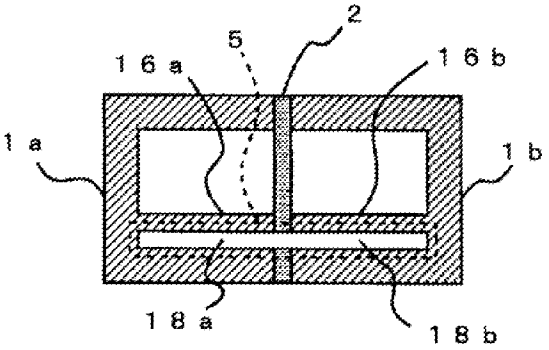
FIG. 8A is a cross-sectional view showing the bandpass waveguide filter taken along a line B-B in FIG. 7A according to the third exemplary embodiment of the present invention.
Figure 8B:
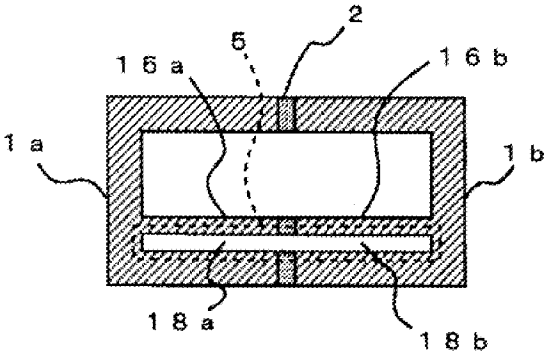
FIG. 8B is a cross-sectional view showing the bandpass waveguide filter taken along a line B'-B' in FIG. 7A according to the third exemplary embodiment of the present invention.
Figure 8C:
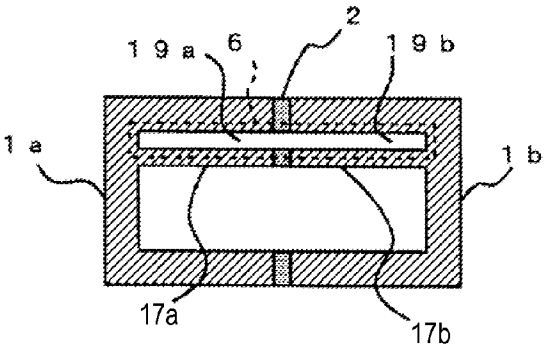
FIG. 8C is a cross-sectional view showing the bandpass waveguide filter taken along a line C-C in FIG. 7A according to the third exemplary embodiment of the present invention.
Figure 8D:
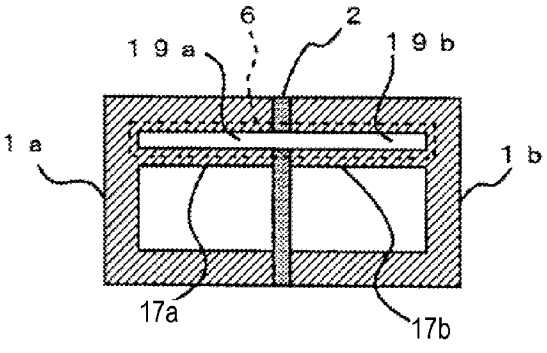
FIG. 8D is a cross-sectional view showing the bandpass waveguide filter taken along a line C'-C' in FIG. 7A according to the third exemplary embodiment of the present invention.

FIG. 8A is a cross-sectional view showing the bandpass waveguide filter taken along a line B-B in FIG. 7A according to the third exemplary embodiment. FIG. 8B is a cross-sectional view showing the bandpass waveguide filter taken along a line B'-B' in FIG. 7A according to the third exemplary embodiment. FIG. 8C is a cross-sectional view showing the bandpass waveguide filter taken along a line C-C in FIG. 7A according to the third exemplary embodiment. FIG. 8D is a cross-sectional view showing the bandpass waveguide filter taken along a line C'-C' in FIG. 7A according to the third exemplary embodiment.

As is shown in FIGS. 8A through 8D, in the present exemplary embodiment, if the E-plane parallel metal plate 2 is sandwiched between the pair of rectangular waveguides 1*a* and 1*b*, then two cross-coupling waveguide paths 5 and 6 are formed within the waveguide. Because each of these cross-coupling waveguide paths 5 and 6 forms a pole, by adjusting the coupling amounts such that each of these poles is positioned outside a pass band in a transient area between the pass band and a stop band, it is possible to further improve the pass characteristics.

Figure 9A:
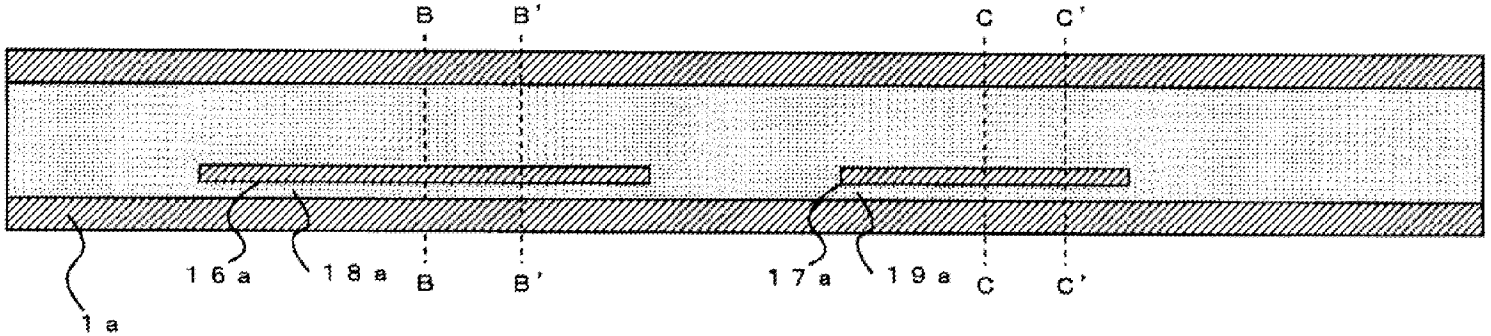
FIG. 9A is a view showing another structure of the rectangular waveguide which is applied to the bandpass waveguide filter according to the third exemplary embodiment of the present invention.
Figure 9C:
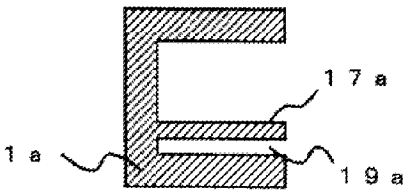
FIG. 9C is a cross-sectional view showing a rectangular waveguide taken along lines C-C and C'-C' shown in FIG. 9A.
Figure 9B:
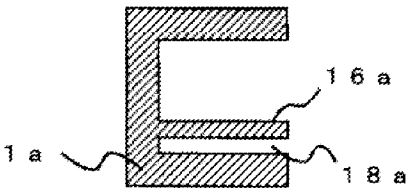
FIG. 9B is a cross-sectional view showing a rectangular waveguide taken along lines B-B and B'-B' shown in FIG. 9A.
Figure 9D:
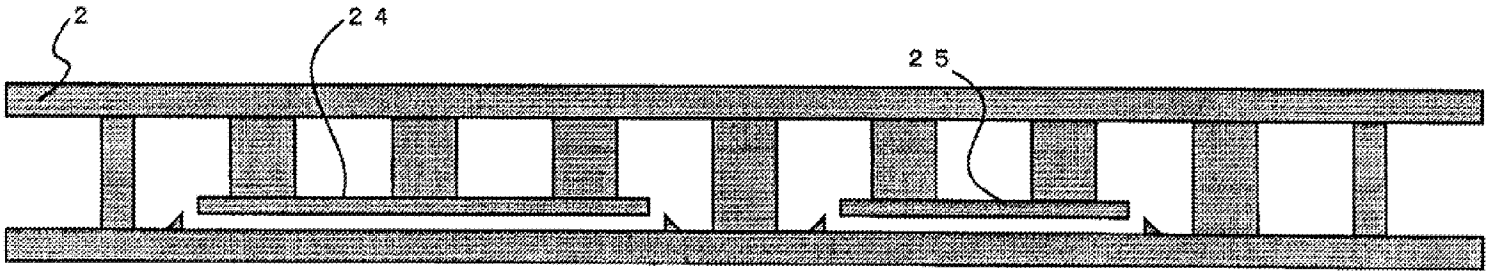
FIG. 9D is a view showing another structure of an E-plane parallel metal plate which is applied to the bandpass waveguide filter according to the third exemplary embodiment of the present invention.

Here, a structure in which cross-coupling waveguide paths are formed respectively in the vicinity of the H-plane on the top side of the rectangular waveguide and the vicinity of the H-plane on the underside thereof has been used as an example. However, as is shown in FIGS. 9A through 9D, it is also possible to employ a structure in which a plurality of cross-coupling waveguide paths are formed in the vicinity of one of the H-planes of the rectangular waveguide 1*a*. FIG. 9A is a view showing another structure of the rectangular waveguide which constitutes the bandpass waveguide filter according to the third exemplary embodiment. FIG. 9B is a cross-sectional view showing the rectangular waveguide 1*a* taken along lines B-B and B'-B' shown in FIG. 9A. FIG. 9C is a cross-sectional view showing a rectangular waveguide 1*a* taken along lines C-C and C'-C' shown in FIG. 9A. FIG. 9D is a view showing another structure of an E-plane parallel metal plate which forms part of the bandpass waveguide filter according to the third exemplary embodiment.

In the bandpass waveguide filter of the present exemplary embodiment as well, in the same way as in the bandpass waveguide filter of the first exemplary embodiment, a pole is generated by cross-coupling resonators together, and by adjusting the coupling amount such that this pole is positioned outside a pass band in a transient area between the pass band and a stop band, it is possible to improve the pass characteristics of a bandpass filter.

In a bandpass filter according to one exemplary embodiment of the present invention, a metal plate which has a substantially ladder shape and in which a pair of beams are connected by a plurality of fins is disposed in parallel with the narrow plane between rectangular waveguides which are divided into two in the center of the broad plane. At least one other waveguide is formed within the rectangular waveguides by dividing the waveguide path in the direction of the narrow plane. Each of the other waveguides couples resonators together by crossing at least one of the resonators that are formed inside the rectangular waveguides by the metal plate, and thereby forms a pole outside the pass band.

A bandpass filter according to another exemplary embodiment of the present invention includes: rectangular waveguides which are divided into two in a center of a broad plane; and a metal plate which has a substantially ladder shape, and is disposed between the rectangular waveguides in parallel with a narrow plane of the rectangular waveguides, and has a pair of beams and plurality of fins that connect the pair of beams. At least one other waveguide is formed by dividing a waveguide path within the rectangular waveguides vertically with respect to a direction which is parallel with the broad plane. At least three resonators are formed within the rectangular waveguides by the metal plate, and each of the other waveguides couples resonators together which crosses at least one of the plurality of resonators so as to form a pole outside a pass band.

While the invention has been particularly shown and described with reference to exemplary embodiments thereof, the invention is not limited to these embodiments. It will be understood by those of ordinary skill in the art that various changes in form and details may be made therein without departing from the scope of the present invention as defined by the claims.

Figure 10A:
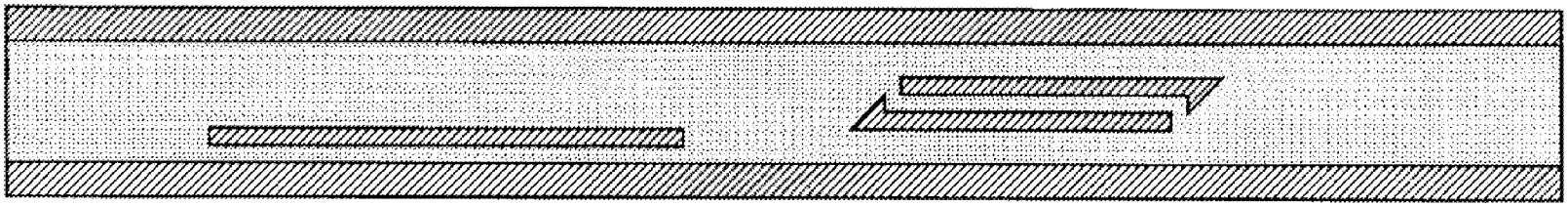
FIG. 10A is a view showing another structure of a rectangular waveguide which is applied to a bandpass waveguide filter according to an exemplary embodiment of the present invention in which a waveguide path which is located in the center in the height direction of the rectangular waveguide, and a waveguide path which is located adjacent to an H-plane thereof are both employed.
Figure 10B:
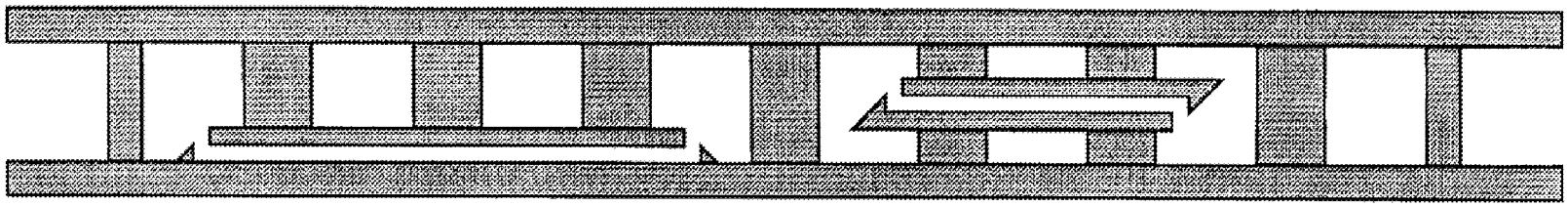
FIG. 10B is a view showing another structure of an E-plane parallel metal plate which is applied to the bandpass waveguide filter according to the exemplary embodiment of the present invention in which the waveguide path which is located in the center in the height direction of the rectangular waveguide, and the waveguide path which is located adjacent to the H-plane thereof are both employed.

For example, using rectangular waveguides and an E-plane parallel metal plate such as those shown in FIGS. 10A and 10B, it is also possible to use a combination of a waveguide path which is located in the center in the height direction of the rectangular waveguide, and a waveguide path which is located adjacent to the H-plane. FIG. 10A is a view showing the structure of a rectangular waveguide which is applied to a bandpass waveguide filter according to another exemplary embodiment of the present invention. FIG. 10B is a view showing the structure of an E-plane parallel metal plate which is applied to a bandpass waveguide filter according to another exemplary embodiment of the present invention.

In this manner, various transformations are possible in the present invention.

This application is the National Phase of PCT/JP2009/006966, filed Dec. 17, 2009, which is based upon and claims the benefit of priority from Japanese patent application No. 2008-332321, filed on Dec. 26, 2008, the disclosure of which is incorporated herein in its entirety by reference.

INDUSTRIAL APPLICABILITY

The bandpass waveguide filter according to the respective exemplary embodiments described above can be applied to RF transmission-reception separation circuits which are located in the input section of simple radio devices that are designed to firm up flexible base network systems at a low cost.

REFERENCE SYMBOLS

1*a*, 1*b* Rectangular waveguide
2 E-plane parallel metal plate
3, 4 Cross-coupling waveguide path
10*a* Coupling window
11*a*, 11*b*, 14*a*, 14*b*, 16*a*, 16*b*, 17*a*, 17*b* Protruding portion
12*a*, 12*b*, 15*a*, 15*b*, 18*a*, 18*b*, 19*a*, 19*b* Groove
13*a* Slope portion
21, 21*a* to 21*i* Fin
22, 23, 24, 25 Beam portion

The invention claimed is:

1. A bandpass filter comprising:

a pair of rectangular waveguides, each of the rectangular waveguides including a broad plane and a narrow plane substantially perpendicular to the broad plane;

a metal plate which has a substantially ladder shape, the metal plate being disposed between the rectangular waveguides in parallel with the narrow planes of the rectangular waveguides, the metal plate including first and second beams and plurality of fins that connect the beams;

at least one other waveguide formed by dividing a waveguide path within the rectangular waveguides vertically with respect to a direction which is parallel with the broad planes of the rectangular waveguides; and at least three resonators formed within the rectangular waveguides by the metal plate, the at least one other waveguide coupling resonators together which cross at least one of the plurality of resonators so as to form a pole outside a pass band, wherein the metal plate further includes a beam portion connected to the first beam by a fin, the beam portion extends in parallel with the narrow planes of the rectangular waveguides, an opening portion is formed between the beam portion and the second beam, each of the rectangular waveguides further includes a protruding portion protruding from the narrow plane and being in contact with the beam portion, each protruding portion is separated from the broad plane so as to form a groove between the protruding portion and the broad plane, each of the rectangular waveguides further includes a slope portion provided on the broad plane, each slope portion is provided apart from the groove, each slope portion has a surface inclined with respect to the broad plane, a height of the opening portion in a direction perpendicular to the broad planes is substantially the same as heights of the grooves in the direction perpendicular to the broad planes, one of the at least one other wave guide is formed by the broad planes, the narrow planes, and the protruding portions of the rectangular waveguides, and the second beam and the beam portion.

2. The bandpass filter according to claim 1, wherein a dimension in the narrow plane direction of the other waveguide is smaller than a dimension in the broad plane direction thereof.

3. The bandpass filter according to claim 1, wherein the pole is formed in a transient area between the pass band and a stop band.

4. The bandpass filter according to claim 1, wherein each slope portion tilts openings in the other waveguide by a predetermined amount relative to the broad plane.

5. A radio device comprising a bandpass filter according to claim 1 which is applied to an RF transmission-reception separation circuit.

6. The bandpass filter according to claim 1, wherein each slope portion includes a first slope portion provided in front of the gap and a second slope portion provided behind the gap.

7. The bandpass filter according to claim 1, wherein each slope portion has a triangular shape when seen from a direction perpendicular to the narrow planes.

* * * * *